US008549665B2

(12) United States Patent
Putfark

(10) Patent No.: US 8,549,665 B2
(45) Date of Patent: Oct. 8, 2013

(54) MEDICAL EXAMINATION DRESS

(76) Inventor: Andrea Lynn Putfark, Pensacola Beach, FL (US)

( * ) Notice: Subject to any disclaimer, the term of this patent is extended or adjusted under 35 U.S.C. 154(b) by 0 days.

(21) Appl. No.: 13/135,217

(22) Filed: Jun. 29, 2011

(65) Prior Publication Data

US 2013/0000012 A1 Jan. 3, 2013

(51) Int. Cl.
*A41B 9/00* (2006.01)
*A41D 1/22* (2006.01)

(52) U.S. Cl.
USPC ..... 2/114; 2/74

(58) Field of Classification Search
USPC ..... 2/114, 78.1, 83, 217, 222, 231, 47, 74, 2/75; D2/720, 840
See application file for complete search history.

(56) References Cited

U.S. PATENT DOCUMENTS

| | | | | | |
|---|---|---|---|---|---|
| 776,054 | A | * | 11/1904 | Glover | 2/114 |
| 776,064 | A | | 11/1904 | Glover | |
| 818,351 | A | | 4/1906 | Clark | |
| 1,489,046 | A | | 4/1924 | Thompson | |
| 2,212,719 | A | * | 8/1940 | Prouty | 2/93 |
| 2,236,636 | A | * | 4/1941 | Young | 2/227 |
| 2,768,383 | A | | 10/1954 | DeWitt | |
| 2,736,900 | A | | 3/1956 | Koren | |
| 2,807,022 | A | * | 9/1957 | Bonanni | 2/114 |
| 2,818,573 | A | | 1/1958 | O'Donnell | |
| 3,116,491 | A | * | 1/1964 | Previdi et al. | 2/106 |
| 3,230,545 | A | * | 1/1966 | Galley | 2/74 |
| 3,276,036 | A | | 10/1966 | Cater | |
| 3,490,072 | A | | 1/1970 | Kettner | |
| 4,995,115 | A | * | 2/1991 | Ellis | 2/69 |
| 5,097,534 | A | * | 3/1992 | Viemeister et al. | 2/69 |
| 5,790,983 | A | * | 8/1998 | Rosch et al. | 2/69 |
| 5,991,923 | A | | 11/1999 | Maria | |
| 6,012,166 | A | | 1/2000 | Burbidge | |
| 6,216,271 | B1 | | 4/2001 | Chen | |
| 6,499,143 | B2 | | 12/2002 | Garza | |
| 7,596,814 | B1 | | 10/2009 | Corby et al. | |
| 2002/0152535 | A1 | * | 10/2002 | Gaza | 2/114 |

* cited by examiner

*Primary Examiner* — Amber Anderson

(57) ABSTRACT

A medical examination dress for women that is suitable for the patient to wear in public for a physician appointment, hospital stay, recovery, etc. The medical exam dress sufficiently covers the body eliminating exposure while maintaining a woman's modesty and dignity and is designed with button mechanics for quick access to specific areas of the body or convertible to a bifurcated garment. The exam dress has buttons at the shoulders straps allowing access to both front and back upper torso areas and down both. The exam dress also buttons down both right and left sides allowing the garment to be folded up and reattached to upper side buttons for access to either front and/or back lower torso areas. There are no metal parts, thereby, allowing use in x-ray and imaging devices.

5 Claims, 4 Drawing Sheets

FRONT VIEW
Folded Up

BACK VIEW
Separate Panel

FRONT VIEW
Fully Buttoned

BACK VIEW
Folded Down

FRONT VIEW
Separate Panel

BACK VIEW
Straps Folded Down

FRONT VIEW
Folded Up

BACK VIEW
Folded Up

MEDICAL EXAMINATION DRESS

BACKGROUND OF THE INVENTION

Field of the Invention

The present invention relates to body garments and more particularly to a medical examination garment for female patients.

The medical examination dress relates to hospital gowns and paper gowns which are provided to patients for wear during medical examinations and procedures. More specifically, it is directed to providing a garment that adequately covers a patient during consultations and examinations while, by the use of the strategically placed buttons and buttonholes, allowing full access to particular body parts while maintaining a woman's modesty and dignity.

The traditional hospital and doctor provided gowns have long been criticized for leaving patients exposed, uncomfortable and embarrassed. There have been many attempts to modify the traditional hospital and/or doctor disposable paper and cloth gowns, most recently Dianne Von Furstenberg's creation for the Cleveland Clinic. Other redesign attempts go back to the 1999 Cynthia Rowley's gown and the redo of its gowns by the Hackensack University Medical Center with the help of designer Nicole Miller. In 2004, the Main Center in Portland introduced a floor length design to accommodate the requests of female Muslim patients. Other garments that are intended for medical purposes include the universal gown, the medical dignity gown, WeberWEAR, the Dear Johnnies gown and Margaret Feodoroff's Design, "Healing Threads". Also, see Exhibits A and B of Information Disclosure statement.

However, the problem of excessive exposure was either not rectified by these gowns or did not differ much from the original gowns. The medical examination dress's unique design, providing button and buttonholes at the top and down each side minimizes patient exposure. The medical examination dress is intended to be patient-owned, thereby assuring patient control of exposure, cleanliness and appearance.

BRIEF SUMMARY OF THE INVENTION

The medical examination dress is a personally-owned examination dress used for medical appointments, medical procedures, medical x-rays, extended hospital stays, etc. It is used in lieu of the physician or hospital provided paper and/or cloth products. The medical examination dress can be worn without fear of embarrassing exposure. I claim the use of the medical examination dress will protect a patient's modesty and provide dignity and confidence to the process of physician and/or medical staff examinations, x-rays, procedures, etc. When dressed in the medical examination dress the patient's body is completely covered. The design of the medical examination dress allows the patient and/or medical staff to prepare for medical procedures with easy access to any or all parts of the patient's body.

The medical examination dress consists of two separate parts, a back and a front, joined together at the sides by buttons and buttonholes. The buttons and buttonholes are strategically located to allow the dress to be adjusted as required for medical examinations and procedures, while also allowing a place for medical tubing, wiring, etc., to fit through the side openings between buttons of the medical examination dress.

DETAILED DESCRIPTION OF INVENTION

The medical examination dress consists of two separate parts, a front and a back. The front has buttonholes down each side and an elastic encased yoke at the top with a button on each side of the front yoke. The back has buttons down each side, an elastic encased yoke at the top, and elastic encased shoulder straps attached to the top of each side of the dress with buttonholes on the end each strap. The elastic encased yoke at the top of both front and back sections allows the dress to be closely fitted at the neck and support the unfitted or gathered parts of the dress. The encased elastic enables the yoke to spring back to its original shape after being stretched or expanded. The two parts are joined together by the buttons and buttonholes down each side of the dress and by buttons on the front top yoke and buttonholes at the top of each shoulder strap. When joined together the two parts become a loose fitting, a-line sleeveless dress with an elastic encased yoke. There are two buttonholes at the bottom corners of the back section of the dress; one on each right and left sides. These buttonholes can be attached to the buttons on the sides of the dress to raise the back skirt to various levels. The front skirt can be raised to various levels by unbuttoning the bottom button and attaching the buttonhole to buttons up each side of the dress. The buttons at the shoulder straps may be unbuttoned to allow the dress, front or back, to be folded down as required. The button and buttonhole design of the medical examination dress allows the patient and/or medical staff to adjust the dress to provide easy access to any or all parts of the body. For example, during a mammogram procedure the top button(s) may be undone allowing the dress top to be folded down exposing one or both breasts for examination. Likewise, the bottom of the dress, front or back, may be folded up for OB-GYN exams or colonoscopy.

Alternative design could be made by replacing the buttons and buttonholes with plastic snaps or tie down straps. However, the plastic snaps are male-female devices which do not allow garment to be adjusted up or down. The tie down straps require inconvenient and cumbersome tying and untying to adjust the garment. The buttons and buttonholes of the medical examination dress provide the means of easily adjusting the garment at various levels and reattaching to secure in place and in addition are a fashion feature that would be lost with the use of plastic snaps or tie downs.

REFERRING TO DRAWINGS

Figure 1A:
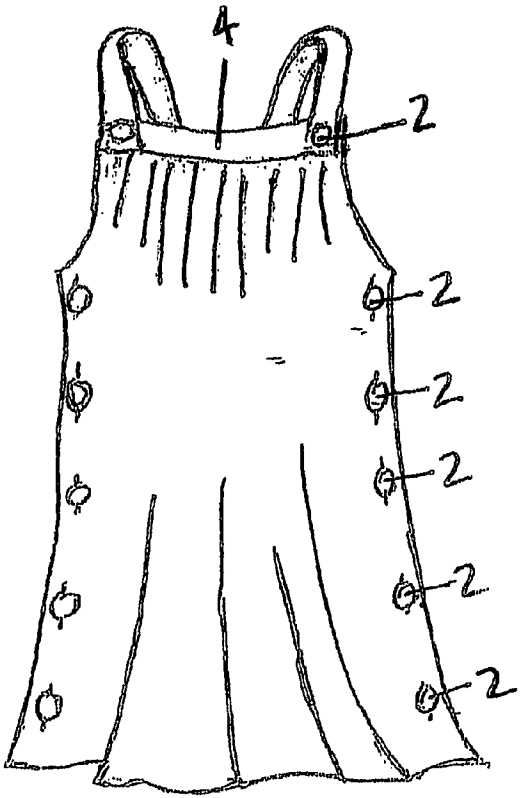
FIG. 1A Provides a front view of the medical examination dress fully buttoned at the sides and straps at the top of the dress.

FIG. 1A Shows a fully buttoned front view of the dress, with buttons (2) down the side and buttons (2) on the elastic encased yoke (4).

Figure 2A:
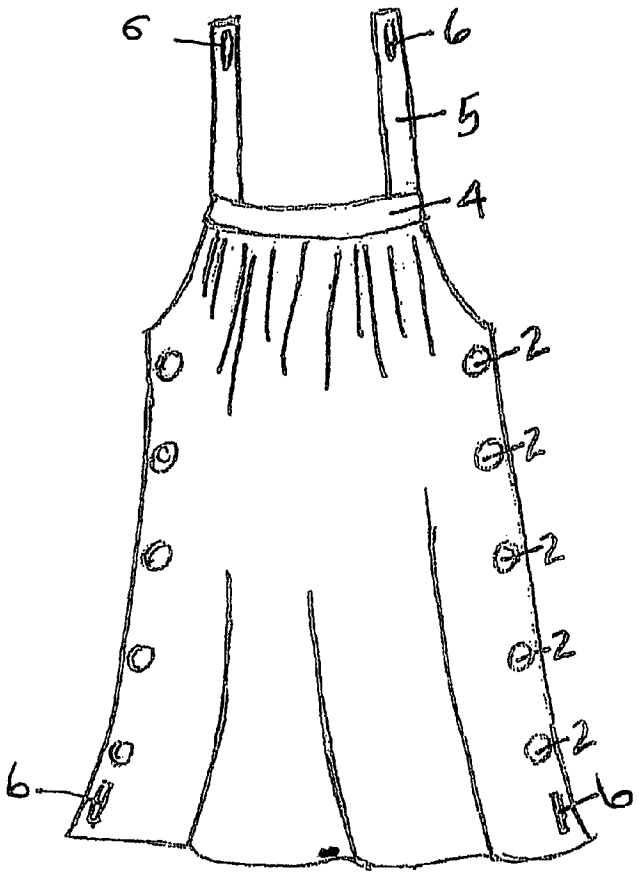
FIG. 2A Provides a view of the back side separate panel with buttons down each side, elastic encased shoulder straps with buttonholes at the end of each strap and a buttonhole at each side of the bottom of the dress.

FIG. 2A Presents a view of the back separate panel of the dress with buttons (2) down each side, straps (5) attached to the elastic encased yoke (4) with buttonholes (6) and a buttonhole (7) at each right and left sides of the bottom panel.

Figure 3A:
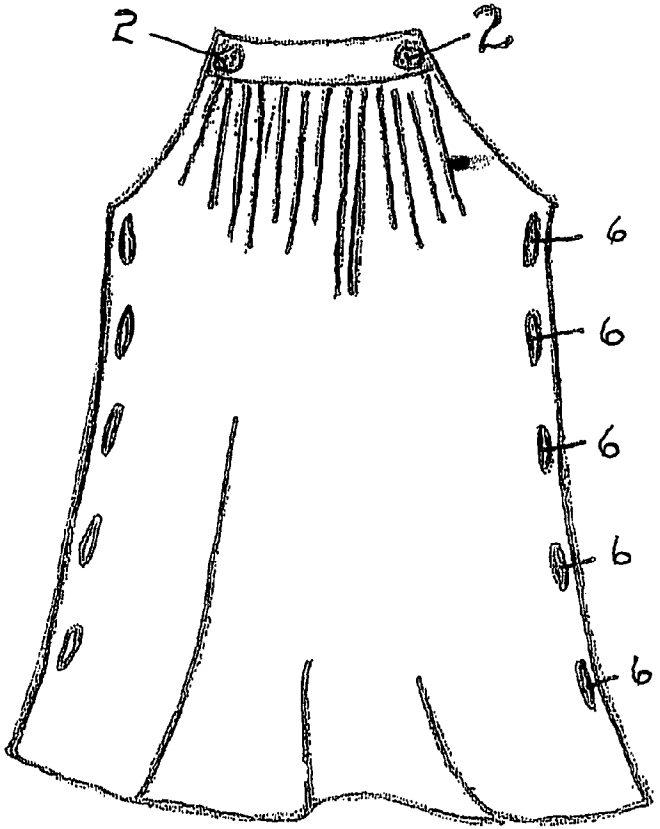
FIG. 3A Provides a view of the front side separate panel with buttonholes down each side, and a button on each side of the front elastic encased yoke.

FIG. 3A Presents a view of the front separate panel of the dress with buttonholes (8) down each side and a button (9) on each side of the elastic encased yoke.

Figure 4A:
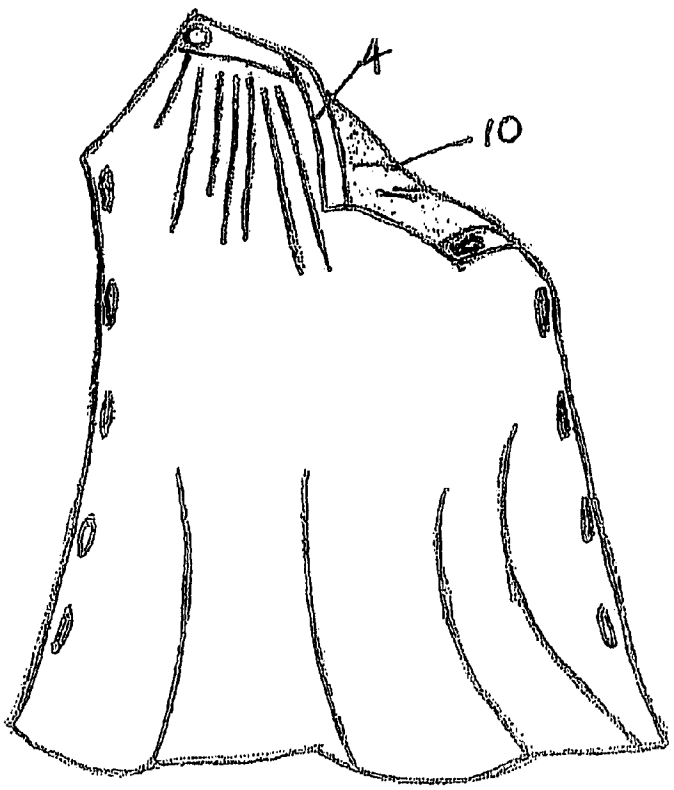
FIG. 4A Provides a view of the medical examination dress with one top strap unbuttoned and folded down.

FIG. 4A Presents a front view of dress with one side of dress (10) and elastic encased yoke (4) folded down.

Figure 5A:
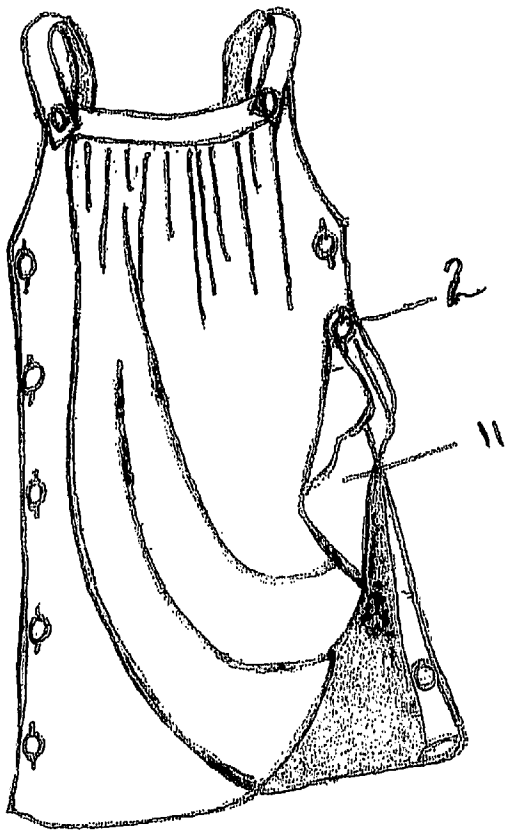
FIG. 5A Provides a view of the medical examination dress with the front bottom unbuttoned, folded up and with the option to reattach to buttons at higher levels on the side to keep panel in place.

FIG. 5A Presents a front view of dress with bottom panel (11) folded up and reattached to upper button (2) to hold in place.

Figure 6A:
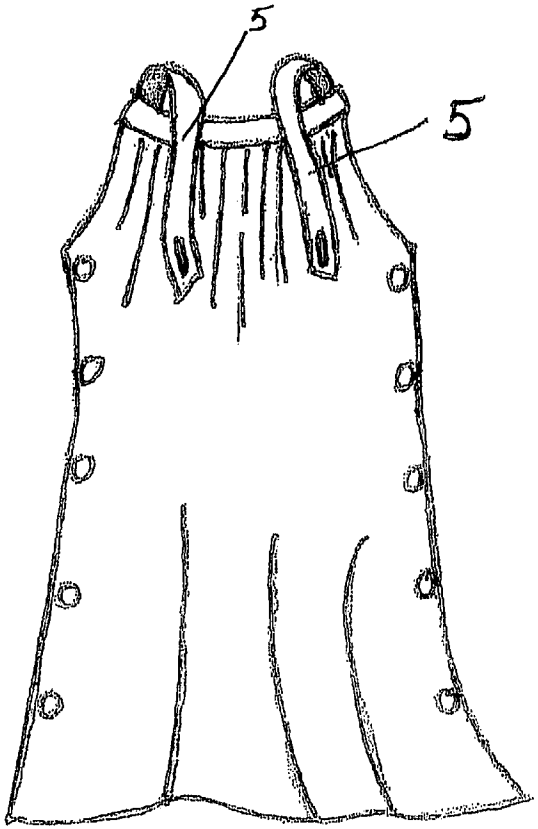
FIG. 6A Provides a front view of the medical examination dress with both straps unbuttoned and front panel folded down.

FIG. 6A Presents a back view of dress with both sides of straps (5) unbuttoned to separate from front panel.

Figure 7A:
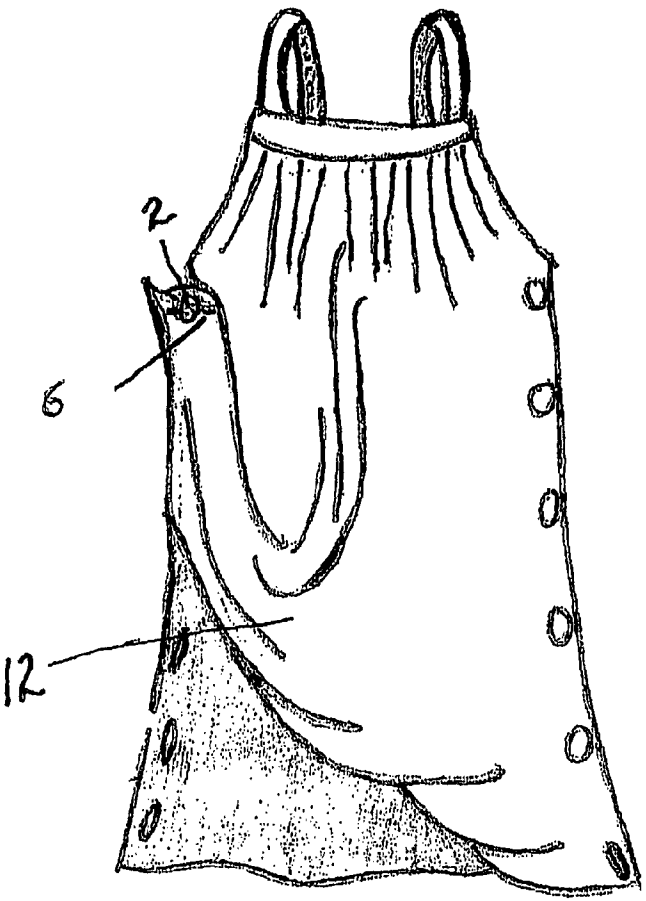
FIG. 7A Provides a back view of the medical examination dress using the back bottom buttonholes buttoned at higher level buttons on the side to keep back panel in place.

FIG. 7A Presents a back view of dress with back bottom panel (12) folded up with buttonhole (7) reattached to upper button (2).

The invention claimed is:

1. A medical examination dress designed to facilitate the raising or lowering of sections of the dress exposing any or all body parts for examinations or procedures, consisting of:

a. two separate material sections defining a front section and a back section, wherein the front section and back section each have a top, a bottom, and two lateral sides;

b. a plurality of buttonholes down each lateral side of the front section;

c. a plurality of buttons down each lateral side of the back section, wherein the number of buttonholes on the front section is equal to the number of buttons on the back section;

d. the back section of the dress having two corners at the intersection of each lateral side with the bottom, wherein a buttonhole is located at each of the two corners;

e. two shoulder straps located at the top of the back section, said two shoulder straps each having a proximal end attached to the top of the back section and a distal end unattached to the back section, said distal end of each strap having a buttonhole for the purpose of attaching to buttons located at the top of the front section of the dress; and f. gathered elastic-encased yokes at the top of both front and back sections of the dress, wherein said buttons located at the top of the front section of the dress are attached to the yoke of the front section.

2. The medical examination dress of claim 1, whereby the front and back sections may be joined together by the buttons and buttonholes down each lateral sides of the front and back sections to form a complete dress or the buttons may be unbuttoned at any or all locations to modify the dress.

3. The medical examination dress of claim 1, whereby the straps may be unbuttoned allowing either or both front and back sections to be folded down.

4. The medical examination dress of claim 1 whereby the front section may be unbuttoned at the bottom, folded up and buttoned at a higher level button.

5. The medical examination dress of claim 1, whereby the bottom of the back section may be folded up and buttoned to buttons at a higher level.

* * * * *